US012044240B2

(12) United States Patent
Sishtla et al.

(10) Patent No.: US 12,044,240 B2
(45) Date of Patent: Jul. 23, 2024

(54) REFRIGERATION SYSTEM MIXED-FLOW COMPRESSOR

(71) Applicant: Carrier Corporation, Palm Beach Gardens, FL (US)

(72) Inventors: Vishnu Sishtla, Manlius, NY (US); William T. Cousins, Glastonbury, CT (US); Michael M. Joly, Hebron, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/972,844

(22) PCT Filed: May 15, 2020

(86) PCT No.: PCT/US2020/033114
§ 371 (c)(1),
(2) Date: Dec. 7, 2020

(87) PCT Pub. No.: WO2020/236581
PCT Pub. Date: Nov. 26, 2020

(65) Prior Publication Data

US 2022/0065256 A1 Mar. 3, 2022

Related U.S. Application Data

(60) Provisional application No. 62/851,896, filed on May 23, 2019.

(51) Int. Cl.
*F04D 19/02* (2006.01)
*F04D 25/06* (2006.01)

(52) U.S. Cl.
CPC ..... *F04D 19/02* (2013.01); *F04D 25/06* (2013.01)

(58) Field of Classification Search
CPC ..... F04D 17/025; F04D 17/12; F04D 19/02; F04D 19/046; F04D 25/06; F04D 25/082;
(Continued)

(56) References Cited

U.S. PATENT DOCUMENTS 2,759,662 A * 8/1956 Carrier ..... F04D 17/122 415/199.2
4,125,345 A * 11/1978 Yoshinaga ..... F04D 25/0606 417/244
(Continued)

FOREIGN PATENT DOCUMENTS

EP 1144826 A1 10/2001
GB 2366333 A 3/2002
(Continued)

OTHER PUBLICATIONS

International Search Report of the International Searching Authority; International Application No. PCT/US2020/033114; International Filing Date: May 15, 2020; Date of Mailing: Jul. 29, 2020; 5 pages.
(Continued)

*Primary Examiner* — Dominick L Plakkoottam
*Assistant Examiner* — Charles W Nichols
(74) *Attorney, Agent, or Firm* — CANTOR COLBURN LLP

(57) ABSTRACT

A compressor includes a housing, a first compression stage defined within the housing, a second compression stage defined within the housing, and a motor disposed between the first compression stage and the second compression stage relative to a flow of fluid through the compressor. The first compression component of the first compression stage has a mixed-flow configuration and the second compression component of the second compression stage has a radial-flow configuration.

15 Claims, 3 Drawing Sheets

(58) Field of Classification Search
CPC .... F04D 29/5806; F04D 29/582; F04D 17/06; F04D 17/122; F04D 25/0606; F04D 29/284; F25B 1/053
See application file for complete search history.

(56) References Cited

U.S. PATENT DOCUMENTS

| | | | | |
|---|---|---|---|---|
| 4,219,306 | A * | 8/1980 | Fujino | F04D 17/12 415/62 |
| 4,224,010 | A | 9/1980 | Fujino | |
| 4,678,398 | A * | 7/1987 | Dodge | F04D 17/06 415/181 |
| 6,488,469 | B1 | 12/2002 | Youssef et al. | |
| 7,856,834 | B2 | 12/2010 | Haley | |
| 8,061,151 | B2 * | 11/2011 | Telakowski | F04D 25/06 62/115 |
| 9,353,765 | B2 | 5/2016 | Haley et al. | |
| 2016/0097297 | A1 * | 4/2016 | Twist | F04D 29/284 415/204 |
| 2016/0222981 | A1 * | 8/2016 | Michelassi | F04D 29/462 |
| 2018/0111676 | A1 * | 4/2018 | Pal | F04D 29/5806 |

FOREIGN PATENT DOCUMENTS

| | | | |
|---|---|---|---|
| WO | 0049296 | A1 | 8/2000 |
| WO | 2017156056 | A1 | 9/2017 |

OTHER PUBLICATIONS

Written Opinion of the International Searching Authority; International Application No. PCT/US2020/033114; International Filing Date: May 15, 2020; Date of Mailing: Jul. 29, 2020; 7 pages.
International Preliminary Report on Patentability; International Application No. PCT/US2020/033114; International Filing Date: May 15, 2020; Date of Issuance: Nov. 16, 2021; 6 pages.
European Office Action for European Application No. 20730845.3; Report Mail Date Mar. 13, 2024 (6 Pages).

* cited by examiner

REFRIGERATION SYSTEM MIXED-FLOW COMPRESSOR

CROSS REFERENCE TO RELATED APPLICATIONS

This application is a National Stage Application of PCT/US2020/033114, filed May 15, 2020, which claims priority to U.S. Provisional Application 62/851,896 filed May 23, 2019, both of which are incorporated by reference in their entirety herein.

BACKGROUND

Embodiments of the disclosure relate generally to a refrigeration system, and more particularly, to a compressor.

Rotary machines are commonly used in refrigeration and turbine applications. An example of a rotary machine includes a centrifugal compressor having an impeller fixed to a rotating shaft. Rotation of the impeller increases a pressure and/or velocity of a fluid or gas moving across the impeller.

In applications using new low-pressure refrigerants, the overall diameter of the compressor is typically large to accommodate the high flow rates. However, these large sizes may exceed the available space within a packaging envelope. There is therefore a need to develop a compressor having a reduced footprint and suitable for use in low pressure refrigerant applications.

BRIEF DESCRIPTION

According to an embodiment, a compressor includes a housing, a first compression stage defined within the housing, a second compression stage defined within the housing, and a motor disposed between the first compression stage and the second compression stage relative to a flow of fluid through the compressor. The first compression component of the first compression stage has a mixed-flow configuration and the second compression component of the second compression stage has a radial-flow configuration.

In addition to one or more of the features described above, or as an alternative, in further embodiments first compression stage and the second compression stage are arranged in series relative to a flow of fluid through the refrigerant.

In addition to one or more of the features described above, or as an alternative, in further embodiments the first compression component is a first impeller rotatable about a first axis and the second compression component is a second impeller rotatable about a second axis.

In addition to one or more of the features described above, or as an alternative, in further embodiments the first impeller further comprises a hub having a front side and a back side, the hub being rotatable about an axis of rotation and a plurality of vanes extending outwardly from the front side of the hub such that a plurality of passages are defined between adjacent vanes, the plurality of vanes being oriented such that a flow output from the plurality of passages adjacent the back side of the first impeller is arranged at an angle to the first axis.

In addition to one or more of the features described above, or as an alternative, in further embodiments the angle of the flow output from the plurality of passages is less than 20 degrees.

In addition to one or more of the features described above, or as an alternative, in further embodiments the flow output from the plurality of passages is arranged generally parallel to the axis of rotation.

In addition to one or more of the features described above, or as an alternative, in further embodiments the first axis and the second axis are coaxial.

In addition to one or more of the features described above, or as an alternative, in further embodiments comprising a volute arranged axially downstream from an outlet of the second compression component.

In addition to one or more of the features described above, or as an alternative, in further embodiments comprising a diffuser section arranged within the housing, the diffuser section being positioned radially downstream from an outlet of the second compression component and upstream from the volute.

In addition to one or more of the features described above, or as an alternative, in further embodiments comprising a diffuser section arranged within the housing, the diffuser section being positioned axially downstream from an outlet of the first compression component.

In addition to one or more of the features described above, or as an alternative, in further embodiments the diffuser section further comprises: a diffuser structure and an axial flow passage defined between an exterior surface of the diffuser structure and an interior surface of the casing.

In addition to one or more of the features described above, or as an alternative, in further embodiments the diffuser structure is generally cylindrical in shape.

In addition to one or more of the features described above, or as an alternative, in further embodiments the diffuser structure is fixed relative to the axis.

In addition to one or more of the features described above, or as an alternative, in further embodiments an outlet of the diffuser section is arranged in fluid communication with at least one flow path extending through the motor section.

In addition to one or more of the features described above, or as an alternative, in further embodiments the motor includes a motor rotor rotatable relative to a motor stator and the at least one flow path further comprises a primary flow path disposed between the motor stator and an adjacent portion of the housing and a secondary flow path arranged between the motor stator and the motor rotor.

In addition to one or more of the features described above, or as an alternative, in further embodiments the primary flow path and the secondary flow path are arranged in parallel.

In addition to one or more of the features described above, or as an alternative, in further embodiments the primary flow path and the secondary flow path are arranged in fluid communication with at least one outlet for delivering fluid to the second compression stage.

In addition to one or more of the features described above, or as an alternative, in further embodiments the at least one outlet is sized to provide the flow of fluid to the second compression stage with a velocity of less than 0.2 Mach.

In addition to one or more of the features described above, or as an alternative, in further embodiments the compressor is operable with a low pressure refrigerant.

In addition to one or more of the features described above, or as an alternative, in further embodiments the compressor is operable with a medium pressure refrigerant.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
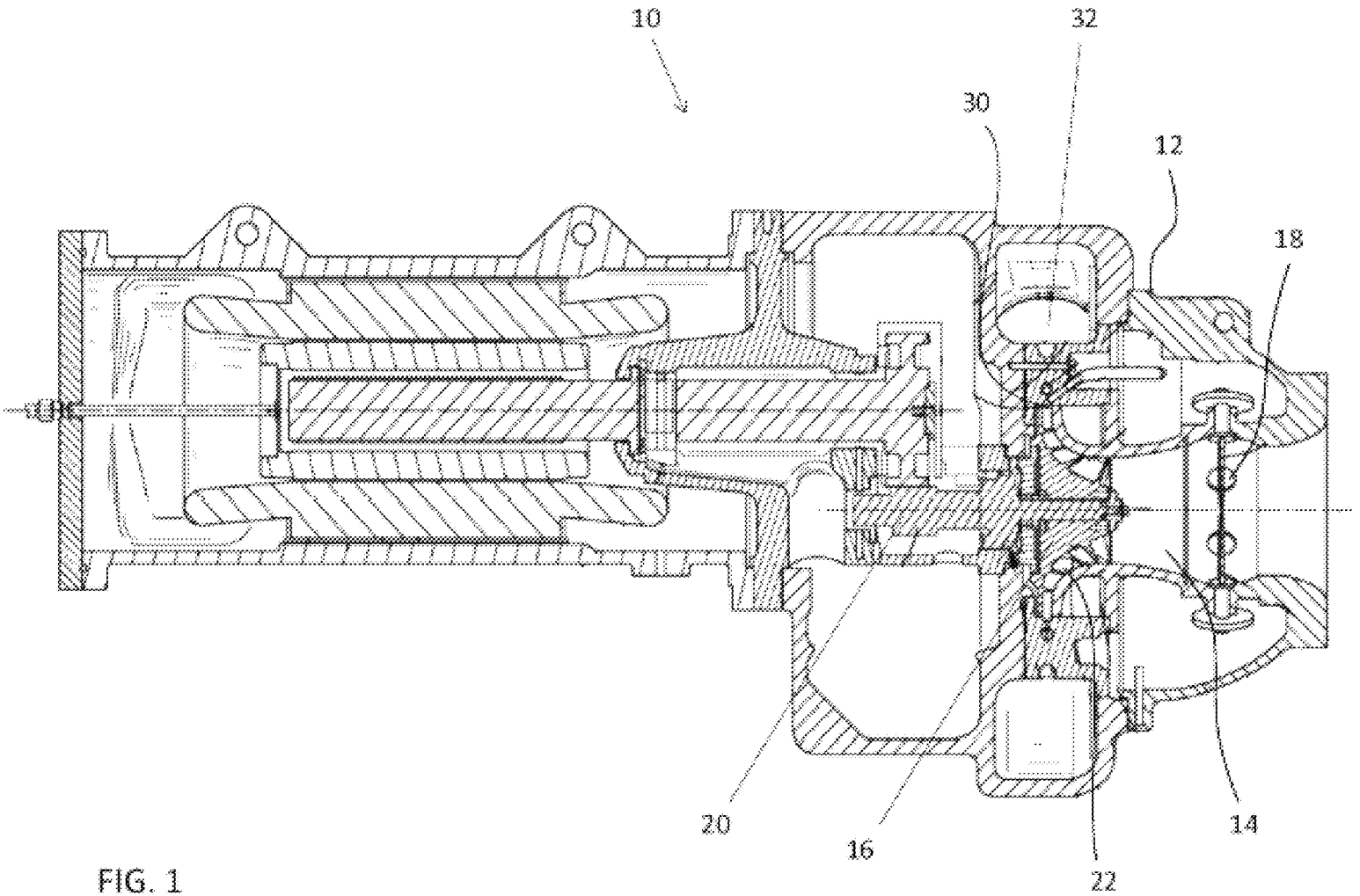
Prior Art FIG. 1
FIG. 1 is a cross-sectional view of a known centrifugal compressor.

Referring now to FIG. 1, an example of an existing centrifugal compressor 10 is illustrated. As shown, the centrifugal compressor 10 includes a main casing 12 having an inlet 14 that directs refrigerant into a rotating impeller 16 through a series of adjustable inlet guide vanes 18. The impeller 16 is secured to a drive shaft 20 by any suitable means to align impeller 16 along the axis of the compressor 10. The impeller 16 has a plurality of passages 22 formed therein that cause the incoming axial flow of a refrigerant fluid to turn in a radial direction and discharge into an adjacent diffuser section 30. The diffuser section 30 is disposed generally circumferentially about the impeller 16 and functions to direct the compressed refrigerant fluid into a toroidal-shaped volute 32, which directs the compressed fluid toward a compressor outlet, or alternatively, toward a second stage of the compressor 10 (not shown), depending on the configuration of the compressor. Because the impeller 16, diffuser section 30, and volute 32 are stacked radially about the rotatable drive shaft 20, an overall diameter of the compressor 10 defined by these components may be large, and therefore unsuitable in applications having size restrictions.

Figure 2:
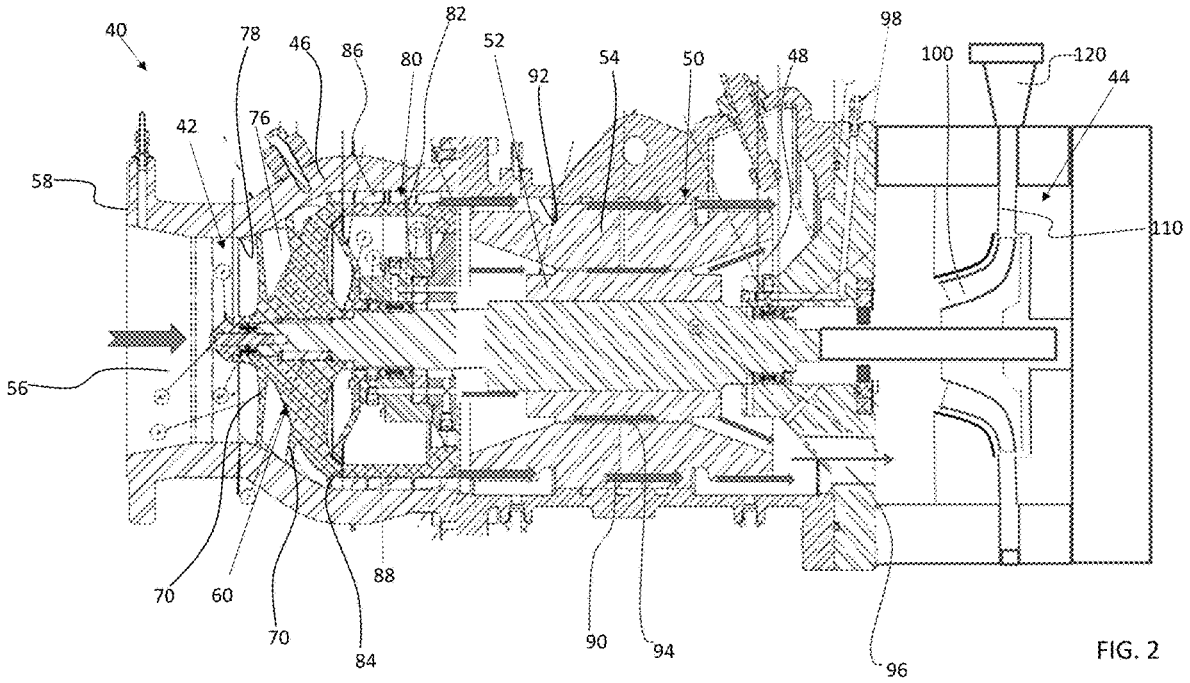
FIG. 2 is a cross-sectional view of a compressor according to another embodiment.

An example of a centrifugal compressor 40 having a reduced diameter relative to existing centrifugal compressors, such as compressor 10 for example, is illustrated in FIG. 2. In the illustrated, non-limiting embodiment, the compressor 40 has multiple stages, for example a first stage 42 and a second stage 44, and each stage has a separate compression component associated therewith. A housing 46 of the compressor 40 not only defines the first stage 42 and the second stage 44, but also defines a motor section 48 having a motor 50 mounted therein. The rotor 52 of the motor 50 is mounted at least partially within the stator 54 and is rotatable about a rotor axis X.

An inlet 56 is formed at a first end 58 of the housing 46 associated with the first stage 42 of the compressor 40. In the illustrated, non-limiting embodiment, a first compression component of the first stage 42 of the compressor 40 includes an impeller 60. The impeller 60 is secured to a drive shaft 62 of the motor 50 such that the impeller 60 is coaxial with the axis X of the motor 50. In operation, a fluid, such as refrigerant for example, provided to the compressor 40 via the inlet 56 is directed axially toward the rotating impeller 60.

Figure 3B:
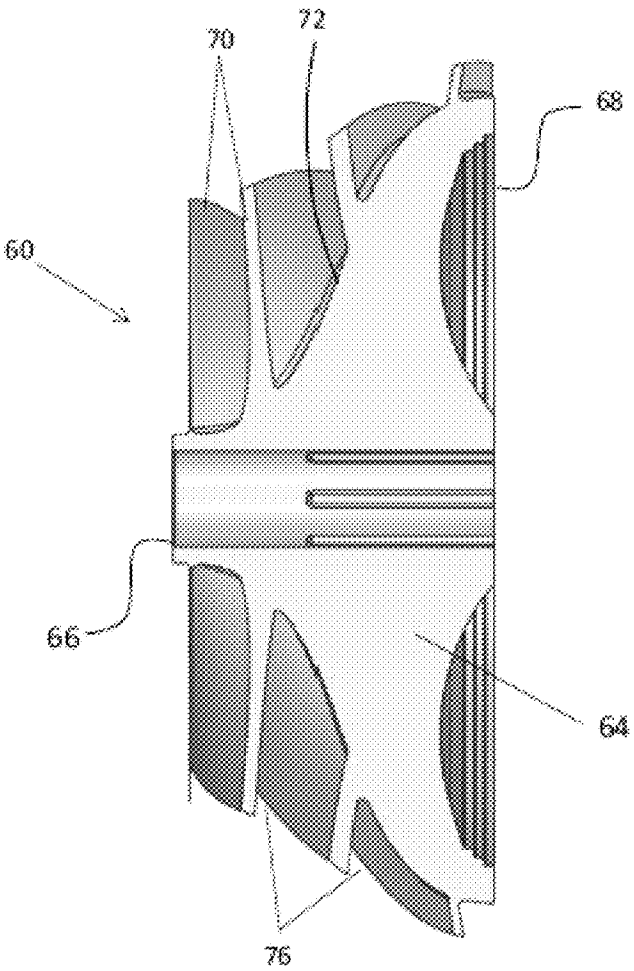
FIGS. 3A and 3B are various view of an example of an impeller according to an embodiment.
Figure 3A:
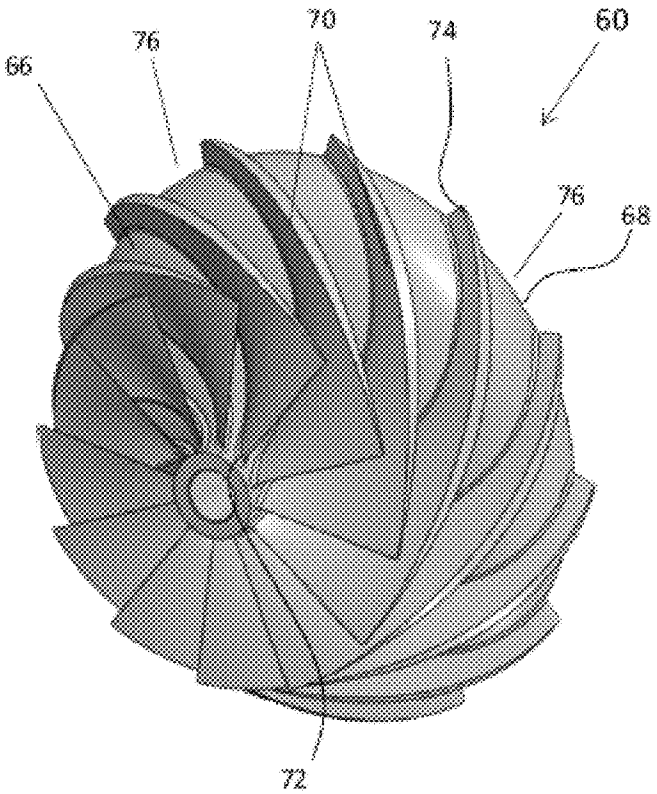

As best shown in FIGS. 3A and 3B, the impeller 60 includes a hub or body 64 having a front side 66 and a back side 68. As shown, the diameter of the front side 66 of the body 64 generally increases toward the back side 68 such that the impeller 60 is generally conical in shape. A plurality of vanes or blades 70 extends outwardly from the body 64. Each of the plurality of blades 70 is arranged at an angle to the axis of rotation X of the drive shaft 62 and the impeller 60. In an embodiment, the impeller 60 has a mixed-flow configuration such that each of the blades 70 extends over the front side 66 of the impeller 60. As shown, each blade 70 includes a first end 72 arranged generally adjacent a front side 66 of the impeller body 64 and a second end 74 located generally adjacent the back side 68 of the impeller 60. Further, the second end 74 of the blade 70 may be circumferentially offset from the corresponding first end 72 of the blade 70.

A plurality of passages 76 is defined between adjacent blades 70 to discharge a fluid passing over the impeller 60 generally parallel to the axis X. As the impeller 60 rotates, fluid approaches the front side 66 of the impeller 60 in a substantially axial direction and flows through the passages 76 defined between adjacent blades 70. Because the passages 76 have both an axial and radial component, the axial flow provided to the front side 66 of the impeller 60 simultaneously moves both parallel to and circumferentially about the axis of the drive shaft 62. In an embodiment, the interior surface 78 (shown in FIG. 2) of the housing 46 at the first stage and the passages 76 of the impeller 60, in combination, cooperate to discharge the compressed refrigerant fluid from the impeller 60. In an embodiment, the compressed fluid is discharged from the impeller 60 at any angle relative to the axis X of the drive shaft 62 into an adjacent diffuser section 80. The angle may between 0°, generally parallel to the axis of rotation X of the drive shaft 62, and less than 90°, less than 75°, less than 60°, less than 45°, less than 30°, less than 20°, less than 10°, or less than 5° for example. Although the mixed-flow impeller illustrated and described herein is unshrouded, embodiments where a shroud is disposed circumferentially about the impeller 60 are also within the scope of the disclosure.

In the illustrated, non-limiting embodiment, the impeller 60 is an unshrouded or open impeller. As used herein, the term "unshrouded" or "open" impeller may refer to configurations of an impeller where a portion of the housing assembly that does not rotate with the impeller and has a clearance relative to the impeller forms a shroud about at least a portion of the impeller. However, it should be understood that embodiments where the impeller 60 is a shrouded impeller are also contemplated herein. In a shrouded impeller, the shroud is configured to rotate with the impeller, and in some embodiments, may be integrally formed with the impeller.

After the refrigerant is accelerated by the impeller 60, a diffuser section 80 may be used to decelerate the refrigerant while converting kinetic energy to pressure energy. As shown, the diffuser section 80 is defined adjacent a downstream end of the impeller body 64 relative to the direction of flow through the compressor 40. In the illustrated, non-limiting embodiment, the diffuser section 80 has an axial fluid flow path oriented substantially parallel to the rotational axis of the impeller 60. Within the diffuser section 80, the fluid flow path may defined between a diffuser structure 82 and the interior surface 78 of the adjacent portion of the compressor housing 46. The diffuser structure 82 is generally tubular or cylindrical in shape and is fixed relative to the axis X. When the diffuser structure 82 is mounted within the compressor 40, a first end 84 of the diffuser structure 82 may directly abut the back side 68 of the impeller 60. Further, the diffuser structure 82 may be mounted such that an outer surface 86 thereof is substantially flush with the front side 66 of the impeller 60 at the interface with the back side 68. In this configuration, the fluid flow through the compressor 40 smoothly transitions from the impeller 60 to the diffuser section 80. The diffuser section 80 may have a vaneless configuration, or alternatively, may include a diffuser structure 82 having a plurality of vanes as described in U.S.

patent application Ser. No. 16/243,833, filed on Jan. 9, 2019, the entire contents of which are incorporated herein by reference.

The axial flow path 88 of the diffuser section 80 directs the compressed fluid flow toward the motor section 48 of the compressor 40. As shown, a primary flow path 90 may be defined between an exterior surface 92 of a motor stator 54 and an interior surface 78 of the housing 46 adjacent the motor 50. The primary flow path 90 has a generally axial configuration and is generally aligned with the flow channel 88 defined between the diffuser structure 82 and the housing 46. Alternatively, or in addition, a secondary flow path 94 may extend between the outer diameter of the motor rotor 52 and the inner diameter of the motor stator 54. The fluid from the diffuser section 80 may be provided to the primary and secondary flow paths 90, 94 in parallel. In an embodiment, an inlet end and an outlet end of each of the primary and secondary flow paths 90, 94 are arranged in fluid communication, respectively. From the outlet end of the primary and secondary flow paths 90, 94, the fluid flow is provided through an outlet 96 formed in an interior wall 98 to the second stage 44 of the compressor 40, located downstream from the motor 50. In an embodiment, a plurality of outlets 96, such as 4-6 openings for example, may be spaced about the interior wall 98 to limit the velocity of the flow of refrigerant there through to less than 0.2 Mach, and in some embodiments, between 0.1 and 0.2 Mach, or less than 0.1 Mach.

In an embodiment the second compression component of the second stage 44 of the compressor 40 is another rotating impeller 100 mounted within the housing 46. As shown, the impeller 100 of the second stage 44 may be located coaxially with the impeller 60 of the first stage 42. Accordingly, the impeller 100 may be directly or indirectly coupled to the drive shaft 62 for rotation about axis X. However, it should be understood that the impeller 100 of the second stage 44 need not be coaxial with the impeller 60 of the first stage 42. Further, a configuration of the impeller 100 of the second stage 44 may be substantially identical to the impeller 60 of the first stage 42, or alternatively may be different than the impeller 60 of the first stage 42. In an embodiment, the second stage impeller 100 has a radial flow configuration and includes a plurality of impeller vanes and a plurality of passages defined between the plurality of impeller vanes. The impeller 100 may be unshrouded as shown, or alternatively, may be shrouded as previously described herein.

In operation, the refrigerant provided to the interior of the second stage 44 via outlet 96, is directed onto the rotating impeller 100. The plurality of impeller vanes, and the corresponding passages defined between adjacent impeller vanes, cause the incoming axial flow of refrigerant to turn in a radial direction and discharge into an adjacent diffuser section 110. The diffuser section 110 is disposed generally circumferentially about the impeller 100 and directs the further compressed refrigerant fluid into a volute identified at 120, such as a toroidal shaped volute, where the refrigerant is collected for subsequent flow to a downstream system component, such as a condenser (not shown) for example.

A compressor 40 as illustrated and described herein is suitable for use with any type of refrigerant, and may be particularly useful with low or medium pressure refrigerants. Low pressure refrigerants typically have evaporator pressure lower than atmospheric pressure and medium pressure refrigerants typically have evaporator pressure above atmospheric pressure. The combination mixed-flow and radial flow compressor 40 may provide a substantial size reduction over existing centrifugal compressors. In addition, because a high pressure ratio is achieved in the single stage described, the compressor 40 may be simplified by eliminating the need for subsequent stages. As a result, the radius of the compressor 40 may be reduced up to about 40% and a length of the compressor 40 may be reduced by more than 10%. Further, the performance of the compressor 40 is improved compared to conventional centrifugal compressors.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A compressor for use in a refrigeration system, the compressor comprising:

a housing;

a first compression stage defined within the housing, the first compression stage including a first impeller rotatable about an axis, wherein a first compression component of the first compression stage has a mixed-flow configuration, wherein a flow of refrigerant at an outlet of the first compression stage is oriented parallel to the axis;

a second compression stage defined within the housing, wherein a second compression component of the second compression stage has a radial-flow configuration, the second compression stage being fluidly connected to and arranged downstream from the first compression stage relative to the flow of refrigerant;

a motor disposed between the first compression stage and the second compression stage relative to the flow of refrigerant through the compressor; and a diffuser section arranged within the housing, the diffuser section being positioned axially downstream from an outlet of the first compression component, the diffuser section being arranged in fluid communication with a plurality of flow paths extending through the motor and arranged in parallel, the plurality of flow paths being arranged in fluid communication with the second compression stage via at least one opening, wherein a flow from the plurality of flow paths is configured to mix at or upstream from the at least one opening.

2. The compressor of claim 1, wherein the first compression component is a first impeller rotatable about a first axis and the second compression component is a second impeller rotatable about a second axis.

3. The compressor of claim 2, wherein the first impeller further comprises:

a hub having a front side and a back side, the hub being rotatable about an axis of rotation;

a plurality of vanes extending outwardly from the front side of the hub such that a plurality of passages are defined between adjacent vanes, the plurality of vanes being oriented such that a flow output from the plurality of passages adjacent the back side of the first impeller is arranged at an angle to the first axis.

4. The compressor of claim 3, wherein the angle of the flow output from the plurality of passages is less than 20 degrees.

5. The compressor of claim 3, wherein the flow output from the plurality of passages is arranged generally parallel to the axis of rotation.

6. The compressor of claim 2, wherein the first axis and the second axis are coaxial.

7. The compressor of claim 1, further comprising a volute arranged axially downstream from an outlet of the second compression component.

8. The compressor of claim 7, further comprising another diffuser section arranged within the housing, the another diffuser section being positioned radially downstream from the outlet of the second compression component and upstream from the volute.

9. The compressor of claim 1, wherein the diffuser section further comprises:

a diffuser structure; and an axial flow passage defined between an exterior surface of the diffuser structure and an interior surface of a casing.

10. The compressor of claim 9, wherein the diffuser structure is generally cylindrical in shape.

11. The compressor of claim 9, wherein the diffuser structure is fixed relative to an axis.

12. The compressor of claim 1, wherein the motor includes a motor rotor rotatable relative to a motor stator and the at least one flow path further comprises a primary flow path disposed between the motor stator and an adjacent portion of the housing and a secondary flow path arranged between the motor stator and the motor rotor.

13. The compressor of claim 1, wherein the at least one outlet is sized to provide the flow of fluid to the second compression stage with a velocity of less than 0.2 Mach.

14. The compressor of claim 1, wherein the compressor is operable with a low pressure refrigerant.

15. The compressor of claim 1, wherein the compressor is operable with a medium pressure refrigerant.

* * * * *